United States Patent [19]

Bloomfield

[11] Patent Number: 4,593,534

[45] Date of Patent: Jun. 10, 1986

[54] ELECTROCHEMICALLY DRIVEN HEAT PUMP

[75] Inventor: David P. Bloomfield, Boston, Mass.

[73] Assignee: Analytic Power Corporation, Boston, Mass.

[21] Appl. No.: 703,865

[22] Filed: Feb. 21, 1985

[51] Int. Cl.[4] ..... F04B 37/02; F04F 11/00

[52] U.S. Cl. ..... 62/201; 62/467; 417/48; 429/30

[58] Field of Search ..... 417/48; 62/56, 201, 62/467, 498; 429/30

[56] References Cited

U.S. PATENT DOCUMENTS 2,913,511 11/1959 Grubb, Jr. ..... 429/30

3,427,978 2/1969 Hanneman et al. ..... 417/48

3,923,426 12/1975 Theeuwes ..... 417/48

*Primary Examiner*—William E. Wayner

[57] ABSTRACT

A refrigeration cycle or heat pump employing an electrochemical compressor. The cycle uses a working fluid at least one component of which is electrochemically active. Another component of the working fluid is condensable. In one embodiment, the electrochemically active component is hydrogen and the condensable component is water. The electrochemical compressor raises the pressure of the working fluid and delivers it to a condenser where the condensable component is precipitated by heat exchange with a sink fluid. The working fluid is then reduced in pressure in a thermal expansion valve. Subsequently, the low pressure working fluid is delivered to an evaporator where the condensed phase of the working fluid is boiled by heat exchange with a source fluid. The evaporator effluent working fluid may be partially in the gas phase and partially in the liquid phase when it is returned from the evaporator to the electrochemical compressor. In the process, heat energy is transported from the evaporator to the condenser and consequently, from the heat source at low temperature to the heat sink at high temperature.

9 Claims, 5 Drawing Figures

ELECTROCHEMICALLY DRIVEN HEAT PUMP

BACKGROUND OF THE INVENTION

1. Field of the Invention

This invention relates to refrigeration cycles and heat pumps and more particularly to systems of the vapor compression type.

2. Description of the Prior Art

The function of both refrigeration cycles and heat pumps is to remove heat from a source or reservoir at low temperature and to reject the heat to a sink or reservoir at high temperature. While many thermodynamic effects have been exploited in the development of heat pumps and refrigeration cycles, the most popular today is the vapor compression approach. This approach is sometimes called mechanical refrigeration because a mechanical compressor is used in the cycle.

Vapor compression refrigeration cycles generally contain five important components. The first is a mechanical compressor which is used to pressurize a gaseous working fluid. After proceeding through the compressor, the hot pressurized working fluid is condensed in a condenser. The latent heat of vaporization of the working fluid is given up to a high temperature reservoir often called the sink. The liquefied working fluid is then expanded at constant enthalpy in a thermal expansion valve or orifice. The cooled liquid working fluid is then passed through an evaporator. In the evaporator, the working fluid absorbs its latent heat of vaporization from a low temperature reservoir often called a source. The last element in the cycle is the working fluid itself.

In conventional vapor compression cycles, the working fluid selection is based on the properties of the fluid and the temperatures of the heat source and sink. The important factors in the selection include the specific heat of the working fluid, its latent heat of vaporization, its specific volume and its safety. The selection of the working fluid affects the coefficient of performance of the cycle.

For a refrigeration cycle operating between a lower limit, or source temperature and an upper limit or sink temperature, the maximum efficiency of the cycle is limited to the Carnot efficiency. The efficiency of a refrigeration cycle is generally defined by its coefficient of performance. The coefficient of performance is the quotient of the heat absorbed from the sink divided by the net work input required by the cycle.

For example, if the source and sink temperatures are 5° F. and 86° F. respectively, the Carnot coefficient of performance is 6.74. If the working fluid is refrigerant 11 (trichloromonofluoromethane) then the coefficient of performance is a maximum of about 5.04. If refrigerant 717 (ammonia) is selected, the maximum coefficient of performance is about 4.76. (See "Properties of Commonly used Refrigerants", Air Conditioning and Refrigeration Research Institute, 1957 ed.) The coefficient of performance associated with the working fluid varies with the required value of the source and the sink temperatures.

Aside from the thermodynamic limitations of the process, conventional mechanical refrigeration requires a relatively large, heavy compressor. The compressor generally has a great number of moving parts which are susceptible to wear. In general, mechanical compressors of the reciprocating, rotary or centrifugal type have volumetric efficiencies which are inversely related to the quantity of gas pumped. Hence a large refrigeration system employing a large compressor will have a higher efficiency than a small system pumping a small amount of working fluid.

There are many applications where the amount of heat to be removed is small and where a bulky mechanical compressor is undesirable. In these applications the designer might choose a vortex tube or a jet compressor. These devices are readily fabricated in small sizes and make use of the relatively high coefficients of performance attainable with vapor compression cycles. They also have the advantage of having no moving parts but they have the disadvantage of low compressor efficiency. For still smaller applications, Peltier effect devices have been employed. These devices, which do not employ a vapor compression principle, often have coefficients of performance less than 0.5.

In all refrigeration devices, the coefficient of performance of the device is inversely proportional to the heat removal capacity of the cycle. Another limitation of the prior art is associated with the control of compressor flow. When a refrigeration load varies, but the source and sink temperatures remain constant, it is desirable to reduce the flow of working fluid through the compressor while simultaneously maintaining the pressure rise across the compressor. This is a difficult job because in a mechanical compressor, the pressure rise and the flow rate are linked by the physical size of the parts of the compressor. In reciprocating compressors, this difficulty is surmounted by unloading cylinders. Unloading cylinders means the removal of flow from one or more of the cylinders in the compressor. This control mode results in very complex control systems and generally degrades the performance of the compressor.

SUMMARY OF THE INVENTION

An object of the present invention is a vapor compression refrigeration system which uses an electrochemical compressor.

Another object of the present invention is a vapor compression refrigeration system which is smaller, less expensive and easier to control than conventional refrigeration systems.

A further object of the present invention is a vapor compression refrigeration system which is more efficient than conventional refrigeration systems.

Accordingly, the present invention is a refrigeration process which is comprised of an electrochemical compressor, a condenser, a thermal expansion valve or orifice and an evaporator. The present invention also includes a means of controlling the operation of the process which can either maintain the heat source or the heat sink at a relatively constant temperature condition. A source of direct current electric power is required to operate the invention. The current source may be a battery or a rectifier or any other electric source capable of delivering direct current. In one embodiment of the invention the various parts of the refrigeration cycle are integrated into a single unit.

An electrochemical compressor as distinguished from a mechanical compressor is a device which can raise the pressure of the working fluid by electrochemical means. An electrochemical compressor has no moving parts. It is inherent in the design of an electrochemical compressor, that at least one component of the working fluid must be electrochemically active. This means that the electrochemically active species must be oxidizable at the anode and reducible at the cathode of an electrochemical compressor. An electrochemical compressor is comprised of a plurality of electrochemical cells called concentration cells, each cell being comprised of an anode, where the electrochemically active component of the working fluid is oxidized; a cathode, where the electrochemically active component of the working fluid is reduced and an electrolyte which serves to conduct ionic species. The electrolyte is generally a solid ion exchange membrane which can withstand an appreciable pressure gradient between its anode and cathode sides. Electrolyte structures, wherein the electrolyte is a liquid held in place by capillary forces, would not be appropriate for use as an electrochemical compressor.

In an embodiment of the present invention the electrochemical compressor is an annular stack of bipolar electrochemical cells electrically connected in series. The cells are of the type generally described by Grubb, in U.S. Pat. No. 2,913,511; Neidrach in U.S. Pat. No. 3,432,355 and Maget, in U.S. Pat. No. 3,489,670.

Each cell in the stack consisting of a hydrogen anode with an electrocatalyst such as platinum, a hydrogen cathode with its electrocatalyst and a solid polymer electrolyte such as Nafion (an ion exchange membrane manufactured by the I. E. DuPont DeNemours Company). The catalysts are intimately bonded to each side of the membrane. The anode and cathode gases within the cells are separated from each other by a bipolar plate. The bipolar plates serve both to separate gases and to facilitate the conduction of electricity from cell to cell. We refer to the electrodes of the cell as the electrocatalytic structure which is bonded to the solid electrolyte. The electrodes are connected to the bipolar plates by porous, electronically conductive structures called current collectors which can be woven metal screens. The pores in the current collectors serve to facilitate the flow of gases within the gas spaces adjacent to the electrodes. This type of electrochemical cell is commonly used in the fuel cell industry and its design is well known to those skilled in the art.

In one embodiment of the present invention, the working fluid is composed of an electrochemically active species, hydrogen, and a condensable species, water. In this embodiment the species are present in the proportion of approximately one part hydrogen and eight parts of water by volume or one part hydrogen and 72 parts of water by weight. The relative proportions of hydrogen and water are governed by the transport number in the electrochemical compressor. The transport number is defined as the number of moles of water per mole of hydrogen pumped by the electrochemical compressor. A solid polymer membrane cell with a Nafion electrolyte (a product of the I. E. DuPont DeNemours Company) has a transport number of approximately eight.

While both electrochemical cells and refrigeration cycle equipment are well known, it is the combination of an electrochemical cell acting as the compressor in a vapor compression refrigeration cycle that distinguishes the present invention from the prior art. Another distinction from the prior art is the electrochemically active nature of the working fluid.

The size reduction of the compressor which is obtainable with the present invention is significant. A twenty-five horsepower mechanical compressor of the sliding vane type weighs approximately 970 pounds (without its electric motor) and occupies a volume of about 36 cubic feet. An equivalent electrochemical compressor pumping the same volumetric flow through the same pressure rise would weigh as little as 126 pounds and occupy a volume of about 2.5 cubic feet.

The power consumed by an electrochemical compressor is related to the pressure rise developed by the compressor and to electrochemical and resistive losses within the cells. The losses are related to the current density at which the cells are operated. Current density is the current flowing through the cell divided by the projected plane area of the cell. Hence a cell having an area of one square foot operating at 100 amp will experience a current density of 100 amp/ft$^2$. The current required by a refrigeration cycle, according to the present invention, is determined by the quantity of working fluid which must be circulated. The area of the cell is selected by the designer. This means that in any application, the designer may choose to construct large cells with small losses or small cells with large losses. The important feature is that the resulting coefficient of performance of the cycle is not dependent on the capacity of the cycle. This is another advantageous characteristic of the present invention.

Control of the operation of an electrochemical compressor consists of turning its current on or off. Alternatively, one can schedule the voltage applied to the electrochemical compressor in proportion to the source or the sink fluid temperature.

While we have described an electrochemical compressor which uses a two component working fluid and which is based on a cationic exchange membrane, it is also possible to conceive of a working fluid such as chlorine which could be used advantageously in a anionic exchange membrane cell. In the case of chlorine, only one working fluid component might be required.

In an electrochemical compressor using an anionic exchange membrane, the electrochemically active component of the working fluid is first reduced at a cathode. The anions formed at the cathode migrate to the anode where they are oxidized. The gas evolved at the anode is at a higher pressure than the fluid entering the cathode. The process is the reverse of the cationic electrochemical compressor previously described.

DESCRIPTION OF THE PREFERRED EMBODIMENTS

Figure 1:
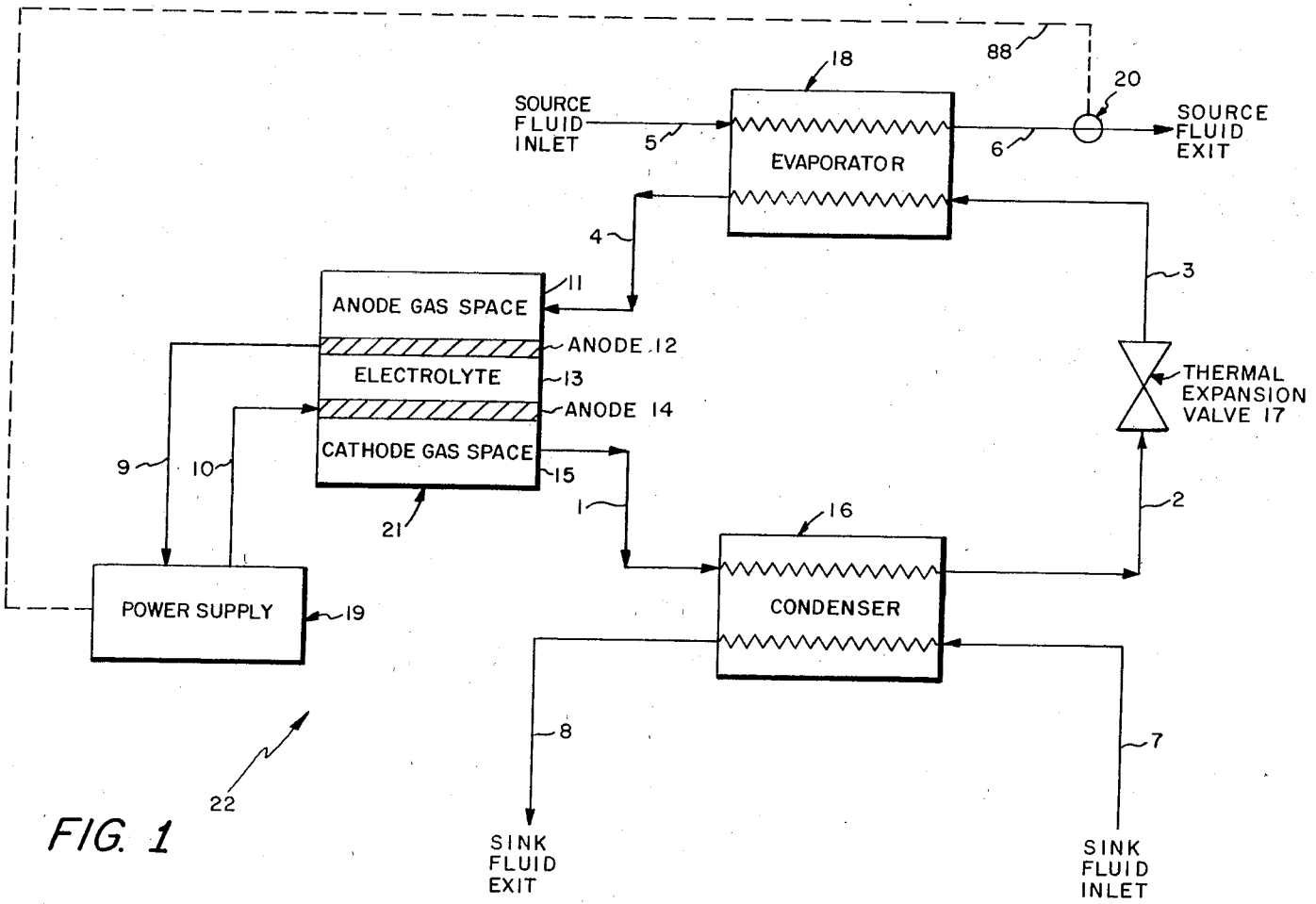
FIG. 1 is a refrigeration cycle according to the present invention.

Consider, as an exemplary embodiment of the present invention, the refrigeration cycle depicted schematically in FIG. 1. The refrigeration cycle depicted is generally indicated by the numeral 22. The cycle is comprised of an electrochemical compressor indicated by the numeral 21, a condenser indicated by the numeral 16, a thermal expansion valve indicated by the numeral 17 and an evaporator indicated by the numeral 18. In addition we show a temperature sensor indicated by the numeral 20 and a direct current power source indicated by the numeral 19.

In the following description, assume the working fluid to be a mixture of one part by volume of hydrogen and eight parts by volume of water. Operation of the embodiment shown in FIG. 1 is as follows. The working fluid which is mostly in a vapor state, is delivered at a high temperature and pressure to the condenser 16 via conduit 1. The temperature and pressure of the working fluid are controlled by the saturation properties of the fluid and the temperature of the source fluid which enters the condenser 16 via conduit 7. Additional restrictions are placed upon the cycle by the allowable operating temperature range of the electrochemical compressor 21. The condenser is a heat exchanger which places two streams a in heat exchange relationship. One stream is the working fluid which enters via conduit 1 and the second stream is the sink fluid which enters the condenser 16 at conduit 7. In the condenser the working fluid gives up its latent heat of vaporization to the sink fluid.

The working fluid leaving condenser 16 via conduit 2 is still at a high temperature and pressure but most of the condensable species, water, is now in a liquid phase. The working fluid enters the thermal expansion valve, which may be an orifice, designated by the numeral 17, via conduit 2. In the thermal expansion valve, the working fluid is expanded at constant enthalpy and leaves the thermal expansion valve 17 via conduit 3. The reduction in pressure and temperature effected by the constant enthalpy expansion of the fluid in the thermal expansion valve 17 is related to the thermophysical properties of the working fluid and to the source fluid temperature entering the evaporator 18 via conduit 5.

The working fluid enters the evaporator 18 via conduit 3 and leaves the evaporator 18 via the conduit 4. The evaporator is a heat exchanger which places the working fluid a in heat exchange relationship with a source fluid. The source fluid enters the evaporator 18 via conduit 5 and leaves the evaporator 18 via conduit 6. In the evaporator, the working fluid absorbs its latent heat of vaporization from the source fluid. This causes the evaporation of the liquid phase of the working fluid within the evaporator 18. Hence the working fluid leaves the evaporator mostly in the vapor phase.

In our discussion of the embodiment shown in FIG. 1 we have alluded to the fact that condensation of the condensable species in the working fluid may be incomplete in condenser 16, and that evaporation of the condensable species in the working fluid in the evaporator 18 may be incomplete. This is one of the advantages of the embodiment which will be made explained in greater detail later.

The working fluid now leaves the evaporator 18 and proceeds to the electrochemical compressor 21 via conduit 4. The schematically illustrated electrochemical compressor 21 is comprised of an anode gas space 11, an anode 12, a solid polymer electrolyte 13, a cathode 14 and a cathode gas space 15. The working fluid enters the anode gas space 11 of the electrochemical compressor 21. Here it is placed in intimate contact with the anode 12. Hydrogen, the electrochemically active species in the working fluid, is oxidized to hydrogen ions at the anode. These ions enter the electrolyte 13. The electrons given up in the oxidation of hydrogen are removed by the power supply 19 via power lead 9. The water in the working fluid enters the electrolyte where it surrounds the hydrogen ions, forming a hydration sheath. In cells which employ a Nafion membrane, generally four molecules of water are required per hydrogen ion.

The power supply 19 pumps the electrons from the anode 12 to a lower electrochemical potential than the anode and feeds the electrons to the cathode 14 of the electrochemical compressor 21 via power lead 10. The hydrogen ions in the electrolyte 13 along with the water of hydration migrate from the anode 12 to the cathode 14 in the presence of the electric potential gradient created by the power supply 19. When the hydrogen ions reach the cathode 14 of the electrochemical compressor 21, they are reduced back to hydrogen molecules which leave the cathode 14 and enter the cathode gas space 15. Likewise, the water of hydration which accompanies the hydrogen ions in their passage through the electrolyte are released into the cathode gas space.

The current applied by the power source 19 determines the amount of hydrogen which will be pumped through the cell. The proportionality between current and the amount of electrochemically active species flowing is defined by Faraday's Law. The voltage which must be applied to the cell is determined by the desired pressure difference between the anode gas space 11 and the cathode gas space 15 and by electrical losses within the electrochemical compressor. The losses in the electrochemical compressor 21 are comprised of electrical resistive losses and polarization losses associated with the oxidation process at the anode 12 and the reduction process at the cathode 14. The portion of the voltage to be applied by the power source 19 which is proportional to the pressure difference between the anode gas space 11 and the cathode gas space 15 is given by the Nernst equation.

In order to effect refrigeration, which involves the pumping of heat energy from the source fluid entering the evaporator 18 via conduit 5 to the sink fluid leaving the condenser 16 via conduit 8, the pressure in the cathode gas space 1f5 of the electrochemical compressor 21 must be higher than the the pressure of the working fluid in the anode gas space 11. Moreover, the amount of the pressure difference between these two components is proportional to the temperature difference between the source and sink temperatures. The electrochemical compressor is a heat engine. The amount of power which is required by the electrochemical compressor 21 and which must be supplied by the power supply 19 is proportional to the quantity of heat energy which is absorbed by the working fluid in the evaporator 18. For the cycle to operate in a steady state, the amount of heat transferred in the condenser 16 must be equal to the sum of heat transferred in the evaporator 18 and the power supplied by the power source 19.

Also shown in FIG. 1 is a means to control the operation of the refrigeration cycle 21. In this embodiment we wish to control the temperature of the source fluid which exits from the evaporator via conduit 6. In this conduit we place a temperature sensor such as a thermocouple so that it is in intimate contact with the fluid in conduit 6. We may place a switch inside the Power Source 19 such that when the temperature of the source fluid is above a desired degree, the switch will close allowing electric power to be applied to the electrochemical compressor 21. When the temperature sensor 20 indicates that the temperature of the fluid in conduit 6 is below a desired temperature, it transmits this signal to the power supply via conduit 88. This signal causes a switch within the power supply 19 to open thereby interrupting the power to the electrochemical compressor 21.

Alternatively we may use the signal from the thermocouple 6 to schedule the voltage applied by the power source 19 to the electrochemical compressor 21. In this way the flow of the working fluid in the cycle 22 is continuously modulated by the power supply 19.

We previously noted that it is desirable for some liquid water to enter the electrochemical compressor 21 via conduit 4. The amount of liquid water should be equal to the quotient of the sum of energy losses of the electrochemical compressor plus the heat of compression of the working fluid vapor phase, divided by the latent heat of vaporization of the condensable species in the working fluid. When this amount of liquid water is supplied to the electrochemical compressor, the electrochemical losses and heat of compression in the cell will cause an amount of liquid water to evaporate, thereby cooling the electrochemical compressor. It is undesirable to circulate water in excess of this amount. Water in excess of this amount will increase the amount of power consumed by the electrochemical compressor 21.

Figure 3:
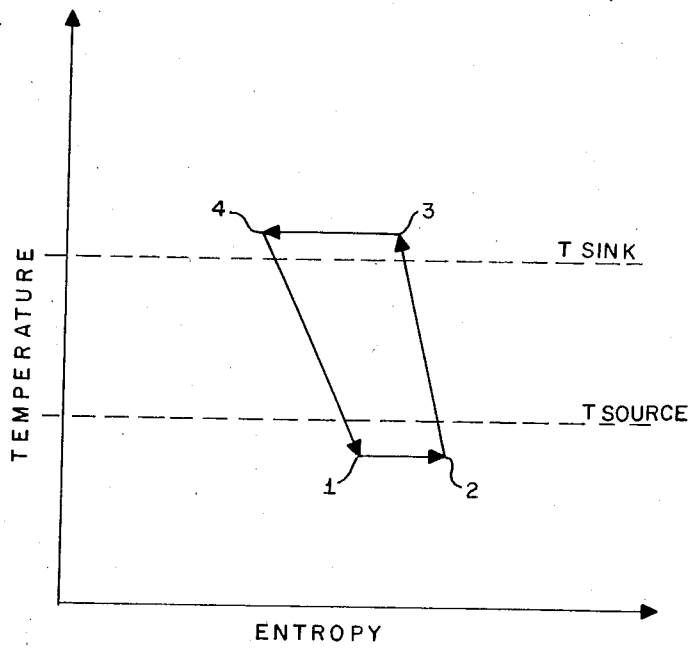
FIG. 3 is a graph illustrating the thermodynamic processes undergone by the electrochemically active, noncondensable component of the working fluid in a cycle according to the present invention.
Figure 2:
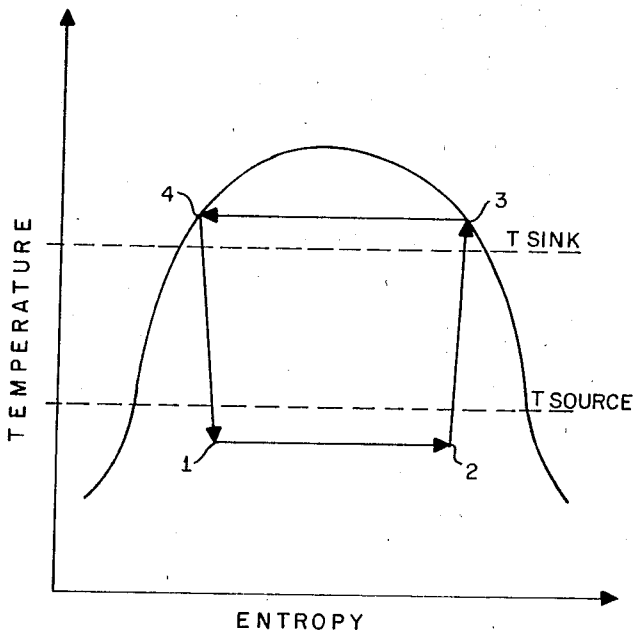
FIG. 2 is a graph illustrating the thermodynamic processes undergone by the condensable component of the working fluid in a cycle according to the present invention.

The thermodynamic process of vapor compression refrigeration is shown in FIG. 2 and FIG. 3. The figures are provided to illustrate the thermodynamic processes involved in the present invention and how they compare to an ideal Carnot cycle and conventional refrigeration cycles.

In FIG. 2 we show the thermodynamic processes undergone by the condensable component of the working fluid of the present invention. In FIG. 3 we show the thermodynamic processes undergone by the electrochemically active noncondensable species component of the working fluid. Referring to FIG. 2, the working fluid condensable species is water. Starting at point 1 in FIG. 2 the water is partially in a vapor state and partially in a liquid state. Proceeding from point 1 to point 2, the water absorbs heat from the source. The area under the line from 1 to 2 is proportional to the amount of heat absorbed. In the process from point 1 to point 2 some of the liquid water is evaporated. The water, both liquid and gaseous phases is next pumped electrochemically from point 2 to point 3. In the compression process from point 2 to point 3, the liquid phase of water at point 2 is evaporated by the absorption of the heat of compression of the water vapor and the hydrogen. The process is designed so that the water at node 3 is completely vaporized. The capability of pumping both liquid and gas phases of the working fluid is an advantageous capability of the electrochemical compressor.

The water, now in a vapor state at point 3 is cooled to point 4 releasing its heat of vaporization. The area under the line formed by points 3 and 4 is proportional to the heat rejected by the water component of the working fluid. At point 4 the water is mostly in liquid state. The water is expanded from point 4 to point 1 at constant enthalpy, completing the cycle for the water component of the working fluid.

Referring now to FIG. 3 we show the thermodynamic processes of the noncondensable component of the working fluid which, in this case, is hydrogen. We start the process at point 1. At this point, the hydrogen is at a temperature which is equal to the temperature of the water at point 1 in FIG. 2. As water is evaporated from point 1 to point 2, the mole fraction of water in the vapor phase of the working fluid increases, while the mole fraction of the hydrogen in this phase must decrease. Because the total pressure in the condenser is constant, the hydrogen partial pressure, which is the product of its mole fraction and the total pressure must decrease. The hydrogen undergoes a constant temperature expansion and absorbs heat from point 1 to point 2. The amount of heat absorbed in the process is proportional to the area under the line formed by points 1 and 2. From point 2 to point 3, the hydrogen partial pressure is increased as the working fluid is compressed in the electrochemical compressor. The partial pressure of the hydrogen is raised by a factor less than the pressure ratio developed by the electrochemical compressor. This is because an amount of water is vaporized in the compressor. The mole fraction of the hydrogen in the vapor phase of the working fluid at point 3 must therefore be lower than the mole fraction of hydrogen at point 2. The temperature of the hydrogen at point 3 must be equal to the temperature of the water at point 3 because the two species are intimately mixed at this point.

The work required to compress hydrogen from point 2 to point 3 is strictly a function of the state points defined by points 2 and 3. These points are controlled by the water present in the electrochemical compressor in both the liquid and vapor phases.

Proceeding from point 3 to point 4, the working fluid is cooled. During this process, the the condensation of the water from the vapor phase of the working fluid causes a decrease in the mole fraction of water and an increase in the mole fraction of hydrogen. Since condensation is carried out at a constant total pressure, the partial pressure of hydrogen is increased by the cooling process.

The process from point 4 to point 1 in FIG. 3 is a throttling process. The hydrogen expands from the pressure at point 4 to the pressure at point 1. The water and the hydrogen at point 4 must be at the same temperature since they are intimately mixed. Since hydrogen is a permanent gas, the expansion process would, in theory, take place at constant temperature. Because of the Joule-Thompson coefficient of hydrogen, the temperature could slightly increase during a constant enthalpy expansion. The hydrogen, however, is admixed with water, and will release heat to the liquid water causing a portion of the liquid water to evaporate until the temperature at point 1 is obtained. From a thermodynamic standpoint, it is irrelevant how the hydrogen proceeds from state point 4 to state point 1. If we assume that the process from point 4 to point 1 is a succession of equilibrium states, and we further assume that the latent heat of vaporization of water does not appreciably vary between point 4 and point 1, we may simply connect the two state points 4 and 1 by a straight line. FIG. 3 then shows that the heat absorbed by the hydrogen component of the working fluid is proportional to the area under the line connecting points 1 and 2 and the heat rejected by the hydrogen is proportional to the area under the line connecting points 3 and 4. The net work which must be supplied to the hydrogen is proportional to the area bounded by the points 1,2,3 and 4.

The total work which must be added to the working fluid by the power source is proportional to the sum of the areas bounded by points 1,2,3 and 4 in FIGS. 2 and 3. The total heat which may be removed from a source by the process is proportional to the sum of the areas beneath lines formed by points 1 and 2 in FIGS. 2 and 3. The total heat which is rejected to a sink is proportional to the sum of areas beneath the lines formed by points 3 and 4 in FIGS. 2 and 3. The absolute location of the points on the temperature vs entropy planes shown in FIG. 2 and FIG. 3 depends on the temperature of the source, the temperature of the sink, the power applied by the power source and the transport number characteristics of the membrane electrolyte in the electrochemical compressor.

Figure 4:
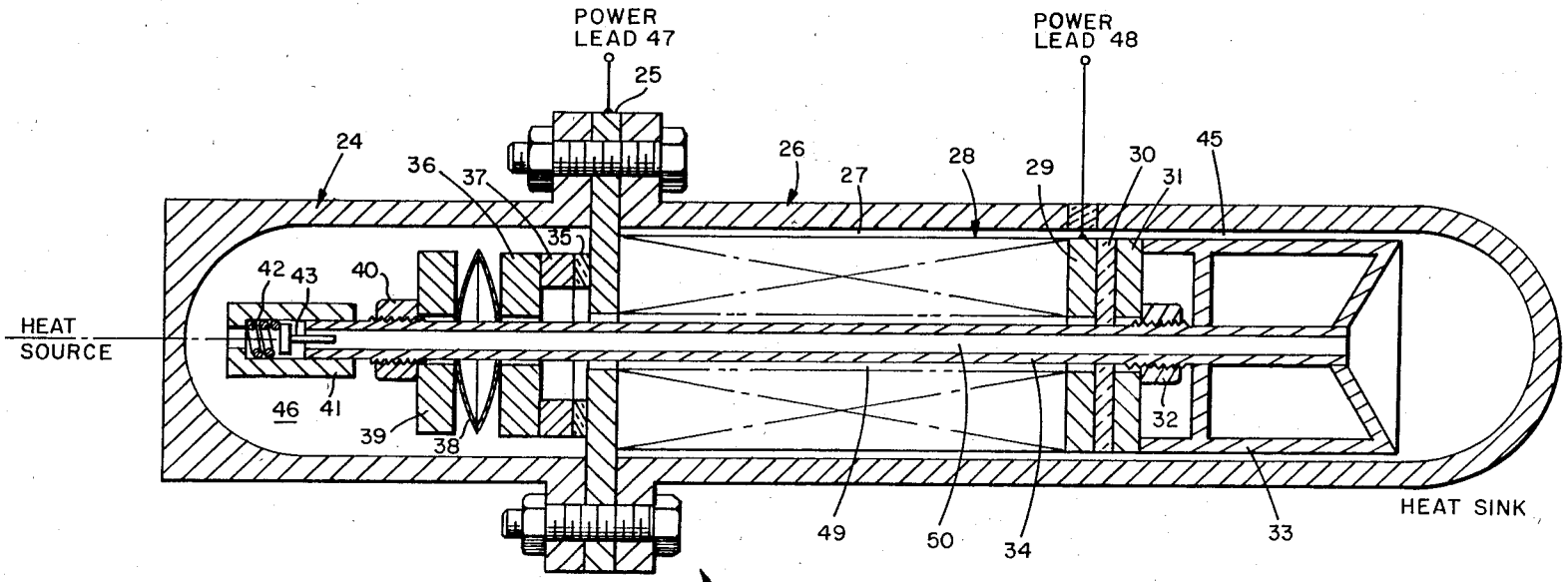
FIG. 4 is a schematic illustration of an embodiment of the present invention which shows how a compact device may be constructed.

FIG. 4 shows another embodiment of the present invention. This figure shows how a compact refrigerating device might be obtained from the present invention. FIG. 4 shows an arrangement of the components previously described in FIG. 1. In FIG. 4 we show a refrigeration cycle generally indicated by the numeral 23 being comprised of an electrochemical compressor 28, and a condensing surface 26 which is externally in intimate contact with a sink fluid such as air. The evaporator surface 24 is initimately connected with a heat source. The thermal expansion valve assembly 41 is housed within the evaporator end of a central element indicated by the numeral 34.

The cell stack in the embodiment is annular in shape. The interior of the annulus forms the anode manifold 49 and serves to contain the anode gases. The working fluid at low pressure flows radially from the anode manifold 49 to the cell anodes. The hydrogen and water components of the working fluid are pumped through the cells to the cathodes. They next flow radially at high pressure to the cathode gas manifold 27.

Electric current is fed to the cell stacks by the leads 47 and 48 from a power supply which is not shown. The electric current flows axially through the cell stack 28. The cathode manifold is formed by the condensor surface 26 and the circumference of the cell stack or electrochemical compressor 28. The gas within the manifold flows axially to the right. A condenser flow plug 33 is incorporated into the device so as to maintain the cathode exhaust gases in intimate contact with the condenser surface 26. The flow plug may be embossed with ridges to impart a spiral flow to the gas contained within the condenser gas space 45 around the condenser flow plug 33. The water in the cathode gas stream is cooled in the cathode exhaust cavity 27 and the condensable component of the working fluid is condensed. The working fluid is not a two phase mixture of water and hydrogen. This mixture enters the center element 34 which is concentric to the electrochemical compressor 28 and contained within the anode manifold 49. The mixture is conveyed down the bore of the center element 50, to the left in FIG. 4, until it reaches the thermal expansion valve. The thermal expansion valve 41 contains a spring 42 and a needle valve 43. The thermal expansion valve of this type is advantageous when it is desired to maintain a constant pressure difference between the condenser and the evaporator irrespective of flow. In situations where the cycle will be run at a relatively constant working fluid flow rate the thermal expansion valve is advantageously replaced by a simple orifice. The two phase working fluid expands through the thermal expansion valve 41 into the evaporator chamber 46.

Heat is conducted through the evaporator surface 24 which causes the liquid phase of the working fluid to evaporate. The vapor and liquid mixture now at low pressure flows through ports 37 in the follow-up plate 36. The working fluid has now reentered the anode manifold of the electrochemical compressor, completing the gas cycle.

In the embodiment shown in FIG. 4, we have shown a means of maintaining the cells of the electrochemical compressor 28 in a state of compression. This is required both to maintain sealing pressure in the electrochemical compressor and to minimize its electrical contact resistance losses. Compression of the electrochemical cell stack is maintained by placing the cells between two end plates 25 and 29. A tensile load is placed on the central element 50 which is balanced by a compressive load on the electrochemical compressor 28. This is accomplished by the assembly of the follow up plate 36, springs 38, backup plates 31 and 39, and nuts 32 and 40. By tightening the nuts 40 and 32 the springs 38 will be compressed. This places the central element 50 in tension and the electrochemical compressor 28 in compression. The follow up assembly is electrically insulated from the cell stack 28 by insulators 30 and 35. This prevents short circuiting of cells by the follow up assembly.

Figure 5:
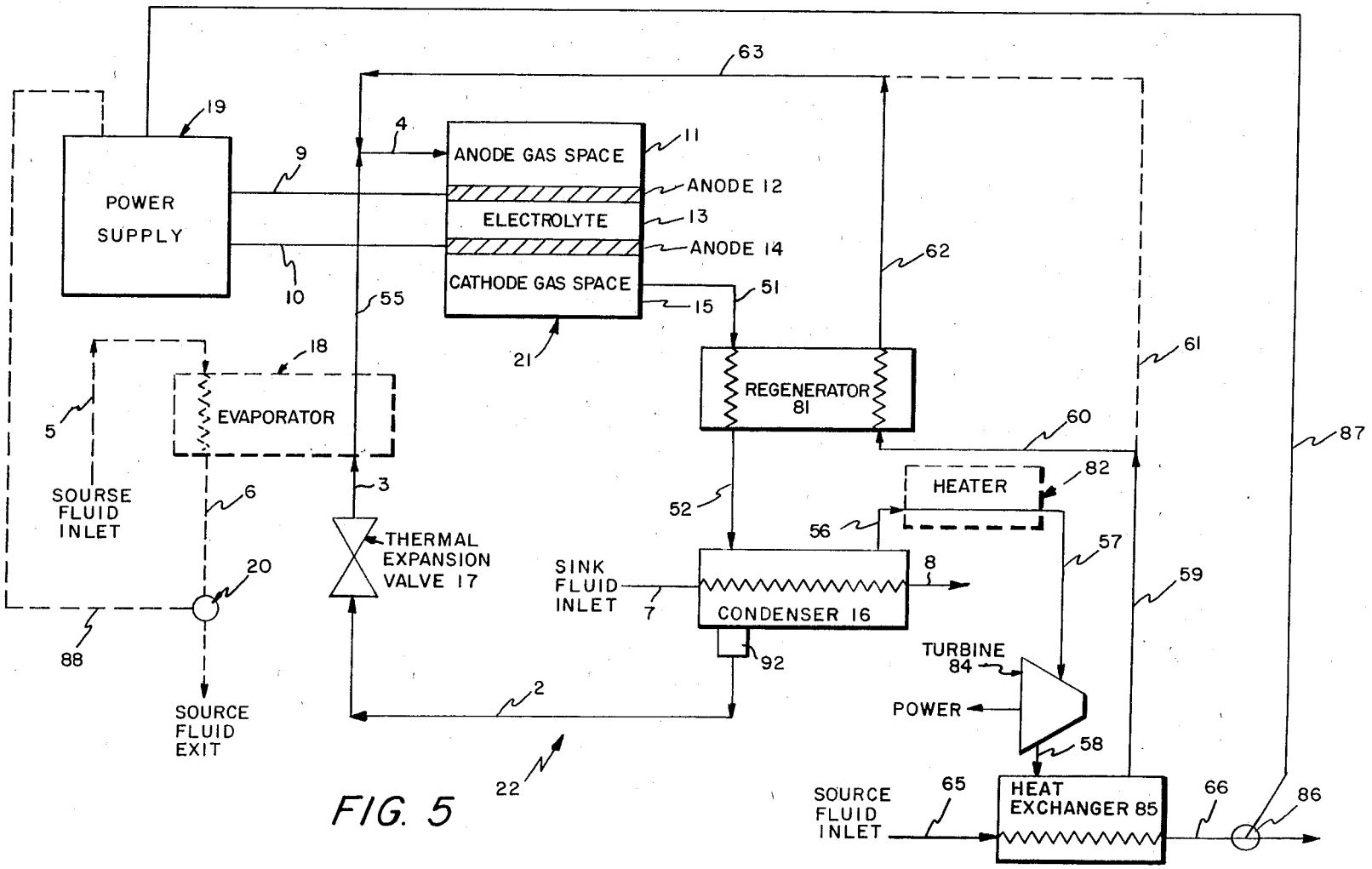
FIG. 5 is a schematic illustration of another embodiment of the present invention which may be used in obtaining very low source temperatures, or reducing power consumption.

FIG. 5 shows yet another embodiment of the present invention. Numerals similar to those of FIG. 1 represent elements the same as those in FIG. 1. This embodiment is similar in operation to the embodiment shown in FIG. 1, but is somewhat more complex due to the separation of the phases of the working fluid in the condenser. Also, a regenerative heat exchanger has been added. FIG. 5 also depicts a modified version of the cycle in dashed lines. In the embodiment shown in FIG. 5, the noncondensable phase of the working fluid is used for cooling the source fluid to a very low temperature.

From our discussion of the embodiment of the invention depicted in FIG. 1, it is apparent that the hydrogen and water may be readily separated in the condenser and that the hydrogen in the condenser has, in fact been compressed by the removal of water from the vapor phase. The hydrogen thus separated could be removed from the cycle shown in FIG. 1, heated and expanded through a turbine or other heat engine, and returned to the refrigeration cycle at the compressor inlet. Such an approach permits the generation of power to offset that power consumed by the refrigeration process. From an energy standpoint this approach is attractive. In the embodiment shown in FIG. 1, the energy of the hydrogen is not so used and must be absorbed by the evaporation of liquid water which reduces the refrigeration effect. The extraction of work from the hydrogen can be effectively used in large systems. Because of the complexity introduced, this feature is not practical in small systems.

It is also apparent that the hydrogen removed from the condenser could be isentropically expanded to obtain very low temperatures which might be useful for cryogenic applications.

The extraction of hydrogen to produce work or to obtain low temperatures is illustrated in the embodiment depicted in FIG. 5. Referring now to FIG. 5, the working fluid leaves the cathode gas space 15 of the electrochemical compressor 21 via conduit 51 at high pressure and temperature. Most of the working fluid is in a gaseous phase. The working fluid enters a regenerative heat exchanger 81 where it is cooled by the the noncondensable phase of the working fluid returning from heat exchanger 85. The noncondensable working fluid enters the regenerative heat exchanger 81 via conduit 60 and leaves via conduit 62. The working fluid which entered the regenerator via conduit 51 is cooled in the regenerative heat exchanger 81 and leaves via conduit 52. Under some operating conditions, it may be possible to condense a portion of the working fluid in the regenerative heat exchanger.

The working fluid in conduit 52 now enters the condenser 16 where it is placed in a heat exchange relationship with the sink fluid which enters via conduit 7. In passing through the condenser 16, the sink fluid is heated and leaves via conduit 8. The working fluid is cooled in the condenser and the condensable component of the working fluid precipitates. The condensed phase of the working fluid is collected in a hotwell 92 which may be part of the condenser 16. The condensate leaves the condenser 16 via conduit 2 and the gas phase of the working fluid leaves the condenser 16 via conduit 56.

The gas phase of the working fluid proceeds from conduit 56 to conduit 57 and enters an expansion device which in this case is depicted as a turbine 84. The working fluid in the turbine undergoes an adiabatic expansion so that the temperature of exit gas from the turbine in conduit 58 is at a very low temperature. If the gas phase of the working fluid is hydrogen then some means of adiabatic expansion must be used. Because of the Joule-Thompson coefficient of hydrogen, a constant enthalpy expansion is not useful for attaining low temperatures in conduit 58.

The cold working fluid now enters a heat exchanger where the working fluid is placed in a heat exchanger relationship with a source fluid. The source fluid which enters via conduit 65 may be cooled to a very low temperature prior to its exit via conduit 66. In this embodiment we show a thermal sensor 86 which is placed in conduit 66 so as to sense the temperature of the source fluid therein. The signal from this sensor is transmitted to the power supply via sensing line 87. The signal so transmitted can be used to control the operation of the refrigeration cycle 22 in a manner as described in FIG. 1. The working fluid is heated in the heat exchanger 85 and leaves via conduit 59. In this embodiment, the working fluid proceeds from conduit 59 to conduit 60 whereupon it enters the regenerative heat exchanger 81 as was previously described. The working fluid now leaves the regenerative heat exchanger 81 via conduit 62 and proceeds to conduit 63. Prior to its entry into the anode gas space 11 of the electrochemical compressor 21, the gas phase of the working fluid in conduit 63 is mixed with the condensable phase of the working fluid in conduit 55. The mixture is delivered to the anode gas space 11 via conduit 4. Upon leaving the hotwell 92 of the condenser 16 via conduit 2, the condensed phase of the working fluid enters a thermal expansion valve 17 where it undergoes a constant enthalpy expansion. This causes some amount of the working fluid to evaporate. The working fluid leaves the thermal expansion valve 17 via conduit 3 and proceeds to conduit 55. The condensable component of the working fluid in conduit 55 is mixed with the noncondensable component of the working fluid in conduit 63 and the mixture is fed to the anode gas space 11 of the electrochemcial compressor 21 via conduit 4.

In this embodiment, it is desirable to maintain most of the condensable component of the working fluid in a liquid state during its circulation through the system 22. Because of the very low specific volume of the liquid, the work done by the electrochemical compressor 21 is minimized when this condition is met.

A modified version of the heretofore described embodiment of FIG. 5 is shown by the dashed lines in FIG. 5. In this alternate embodiment the noncondensable effluent leaving the condenser via conduit 56 is heated in a heater 82 prior to proceeding to the turbine 84. The regenerator 81, in this alternate embodiment may be bypassed by conduit 61. In addition, an evaporator 18 similar to that shown in the embodiment of FIG. 1 is placed between the thermal expansion valve 17 and the electrochemical compressor 21. In this embodiment, the heat exchanger 85 may be eliminated. The source fluid enters the evaporator 18 via conduit 5 rather than the heat exchanger 85 via conduit 65. Also, the temperature sensor 86 and its signal transmission line 87 are replaced by temperature sensor 20 and its signal line 88.

In this alternative embodiment, a quantity of heat is added to the noncondensable component of the working fluid in conduit 56 so that on its subsequent expansion through the turbine 84 the temperature and pressure of the the turbine effluent in conduit 58 will be approximately equal to the pressure and temperature of the condensable component of the working fluid leaving the evaporator. The use of this alternative embodiment permits the extraction of work from the noncondensable component of the working fluid. This offsets the power which is required by the electrochemical compressor. In addition, if the work is not so extracted, as it is not in the embodiment of FIG. 1, then this quantity of work will cause the evaporation of additional amounts of condensable component working fluid in the evaporator which reduces the refrigeration effect.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment for my invention, that which I claim as new and desire to secure by Letters Patent of the United States is:

1. A refrigeration cycle which conveys heat from a first heat reservior at low temperature to a second heat reservoir at high temperature comprising:

an electrochemical compressor including a plurality of electrochemical cells electrically connected in series through a power supply, each cell comprising a cathode electrode, an anode electrode, a solid electrolyte disposed therebetween, a cathode gas space on the nonelectrolyte side of said cathode electrode and an anode gas space on the nonelectrolyte side of said anode electrode;

a working fluid at least one component of which is electrochemically active and one component of which is condensable;

a first heat transfer means for cooling of the working fluid;

expansion means for reducing the pressure of the working fluid;

a second heat transfer means for heating the working fluid;

means for delivering working fluid from the said electrochemical compressor to the said first heat transfer means;

means for delivering the working fluid from the said first heat transfer means to the said expansion means;

means for delivering the working fluid from the said expansion means to the said second heat transfer means;

means for delivering the working fluid from the said second heat transfer means to the said electrochemical compressor;

temperature control means operably connected to the heat reservoirs;

temperature control means operably connected to the working fluid.

2. The refrigeration cycle according to claim 1 where the working fluid is comprised of separate electrochemically active and condensable components;

an electrochemically active species of the working fluid is hydrogen;

a condensable species is water.

3. The refrigeration cycle according to claim 1 where the solid electrolyte is a fluoropolymer ion exchange membrane.

4. A refrigeration cycle according to claim 1 where an anionic exchange membrane is used in the electrochemical compressor and the anode gas space operates at a higher pressure than the cathode gas space.

5. A refrigeration cycle which conveys heat from a first heat reservoir at low temperature to a second heat reservoir at high temperature comprising:

an electrochemical compressor including a plurality of electrochemical cells electrically connected in series through a power supply, each cell comprising a cathode electrode, an anode electrode, a solid electrolyte disposed therebetween, a cathode gas space on the nonelectrolyte side of said cathode electrode and an anode gas space on the nonelectrolyte side of said anode electrode;

a working fluid at least one component of which is electrochemically active and another which is condensable;

a regenerative heat transfer means for cooling cathode effluent and heating the noncondensable component of the working fluid;

a condenser means for cooling and separating the condensable and noncondensable components of the working fluid by placing the working fluid in heat exchange relationship with a sink fluid;

a first pressure reduction means for reducing the pressure and temperature of the noncondensable component of the working fluid;

a heat transfer means for cooling a source fluid and heating the noncondensable component of the working fluid;

a second pressure reduction means for reducing the pressure of the condensable component of the working fluid;

a temperature sensing means operably connected to the source fluid;

means for delivering cathode effluent working fluid to the said regenerator heat transfer means;

means for delivering the working fluid from the said regenerator heat transfer means to the said condensor means;

means for delivering the noncondensable working fluid component from the said condenser means to the said first pressure reduction means;

means for delivering the noncondensable component of the working fluid from the said first pressure reduction means to the said heat transfer means;

means for delivering the noncondensable component of the working fluid from the said heat transfer means to the said regenerative heat transfer means;

means for delivering the noncondensable component of the working fluid from the said regenerative heat transfer means to the said electrochemical compressor anode gas space;

means for delivering the condensable component of the working fluid from the condenser to the said second pressure reduction means;

means for delivering the condensable component of the working fluid from the said second pressure reduction means to the said electrochemical compressor anode.

6. A refrigeration cycle according to claim 5 where the first pressure reduction means is a turbine.

7. A refrigeration cycle according to claim 5 where a heater is interposed between the condenser means and the first pressure reduction means.

8. A refrigeration cycle according to claim 5 where an evaporator means is interposed between the second pressure reduction means and the anode gas space of the electrochemical compressor;

a sink fluid is employed to cool the working fluid in the evaporator means.

9. A refrigeration cycle according to claim 5 where an anionic exchange membrane is used in the electrochemical compressor and the anode gas space operates at a higher pressure than the cathode gas space.

* * * * *